US006012629A

United States Patent [19]

Newcomer

[11] Patent Number: 6,012,629

[45] Date of Patent: Jan. 11, 2000

[54] FLAT BOTTOM STRUCTURE FOR COLLAPSIBLE CONTAINER

[75] Inventor: Donald Newcomer, Erie, Pa.

[73] Assignee: Inland Paperboard and Packaging, Inc., Indianapolis, Ind.

[21] Appl. No.: 09/052,724

[22] Filed: Mar. 31, 1998

Related U.S. Application Data

[60] Provisional application No. 60/044,737, Apr. 18, 1997.

[51] Int. Cl.[7] ..... B65D 5/36

[52] U.S. Cl. ..... 229/109; 229/117; 229/122.27; 229/122.28

[58] Field of Search ..... 229/109, 117, 229/117.05, 117.06, 122.27, 122.28, 122.29, 122.3, 122.31

[56] References Cited

U.S. PATENT DOCUMENTS

| | | | |
|---|---|---|---|
| 756,311 | 4/1904 | Adams | 229/122.28 |
| 1,720,146 | 7/1929 | Reese . | |
| 1,792,370 | 2/1931 | Goodman | 229/117.05 |
| 2,083,345 | 6/1937 | Paige | 229/122.27 |
| 2,826,350 | 3/1958 | Marx . | |
| 2,858,968 | 11/1958 | Pellaton . | |
| 2,934,254 | 4/1960 | Ullger . | |
| 3,083,889 | 4/1963 | Christensson . | |
| 3,101,167 | 8/1963 | Styler . | |
| 3,115,291 | 12/1963 | Kotowick . | |
| 3,123,276 | 3/1964 | Mairs | 229/117.06 |
| 3,132,791 | 5/1964 | Haysler et al. . | |
| 3,251,533 | 5/1966 | Cohen | 229/122.27 |
| 3,344,971 | 10/1967 | Walker et al. . | |
| 3,373,917 | 3/1968 | Cox . | |
| 3,525,466 | 8/1970 | Robinson . | |
| 3,561,667 | 2/1971 | Saltman . | |
| 3,565,235 | 2/1971 | Brown et al. . | |
| 3,642,192 | 2/1972 | Wilcox, Jr. et al. . | |
| 3,809,310 | 5/1974 | VanderLugt, Jr. . | |
| 3,877,631 | 4/1975 | Lai et al. . | |
| 4,109,985 | 8/1978 | Lieb, Jr. . | |
| 4,146,169 | 3/1979 | Meyers et al. . | |
| 4,166,567 | 9/1979 | Beach, Jr. et al. . | |
| 4,185,764 | 1/1980 | Cote . | |
| 4,199,098 | 4/1980 | Lopez . | |
| 4,243,171 | 1/1981 | Prin . | |
| 4,244,510 | 1/1981 | Snyder et al. . | |
| 4,260,100 | 4/1981 | Hoffman . | |
| 4,289,267 | 9/1981 | Mayea . | |
| 4,428,499 | 1/1984 | Nauuheimer . | |
| 4,448,309 | 5/1984 | Roccaforte et al. . | |
| 4,453,665 | 6/1984 | Roccaforte et al. . | |
| 4,470,540 | 9/1984 | Koltz . | |
| 4,549,690 | 10/1985 | Rosenburg . | |

(List continued on next page.)

FOREIGN PATENT DOCUMENTS

| | | |
|---|---|---|
| 2574755 | 6/1986 | France . |
| 2 243 596 | 11/1991 | United Kingdom . |

*Primary Examiner*—Gary E. Elkins
*Attorney, Agent, or Firm*—Barnes & Thornburg

[57] ABSTRACT

A collapsible container movable between a collapsed position and an expanded position having a body including a side panel arranged to define an interior region and a bottom panel including a floor having a first floor section and a second floor section coupled to the first floor section at a floor fold line to enable pivoting movement of the second floor section relative to the first floor section about the floor fold line, a first collapsible floor mount coupled to the first and second floor sections and to the side panel, and a second collapsible floor mount coupled to the first and second floor sections and to the side panel, the first and second collapsible floor mounts cooperating to support the floor in one of a flat position wherein the first and second floor sections lie in coplanar relation to one another when the collapsible container is arranged in an expanded, opened position and a collapsed position wherein the second floor section is pivoted about the floor fold line to lie in close proximity to the first floor section and the floor fold line is positioned to lie outside the interior region defined by the side panel when the collapsible container is arranged in a collapsed, flattened position.

38 Claims, 9 Drawing Sheets

U.S. PATENT DOCUMENTS

| | | |
|---|---|---|
| 4,607,785 | 8/1986 | Croley . |
| 4,676,429 | 6/1987 | Crowe et al. . |
| 4,742,915 | 5/1988 | Ringer . |
| 4,747,485 | 5/1988 | Chaussadas . |
| 4,760,922 | 8/1988 | Northgrave . |
| 4,834,255 | 5/1989 | Boots . |
| 4,854,474 | 8/1989 | Murray et al. . |
| 4,856,705 | 8/1989 | Carr et al. . |
| 4,871,068 | 10/1989 | Dreyfus . |
| 4,881,683 | 11/1989 | Linnemann . |
| 4,917,289 | 4/1990 | Linnemann et al. . |
| 5,040,721 | 8/1991 | Essack . |
| 5,115,965 | 5/1992 | Alepuz . |
| 5,295,623 | 3/1994 | Bacques et al. . |
| 5,531,374 | 7/1996 | Gasper . |
| 5,613,694 | 3/1997 | Gasper . |
| 5,630,543 | 5/1997 | Dugan . |
| 5,715,991 | 2/1998 | Gasper . |
| 5,816,483 | 10/1998 | Gasper . |

FLAT BOTTOM STRUCTURE FOR COLLAPSIBLE CONTAINER

This application claims priority under U.S.C §119 (e) to U.S. Provisional Application No. 60/044,737, filed Apr. 18, 1997, which is expressly incorporated by reference herein.

BACKGROUND AND SUMMARY OF THE INVENTION

The present invention relates to collapsible containers, and particularly to bottom structures for collapsible containers made of paperboard. More particularly, the present invention relates to a relatively flat bottom structure for a rapid set-up, octagon-shaped bulk box.

One problem with known rapid set-up, octagon-shaped bulk boxes is that tabs used to form a portion of the bottom structure of such boxes tend to extend upwardly from the box floor into an interior region of such boxes when the boxes are expanded to assume upright, erected configurations. Many box users prefer a box that, once erected, has an open interior region free of any upwardly extending tabs and a relatively flat interior bottom wall or floor.

According to the present invention, a collapsible container includes a multi-sided body formed to include a top opening and a bottom opening, a bi-fold floor, and a plurality of tabs coupled for pivotable movement to the body. The body is configured to be folded from an expanded, opened position to a collapsed, flattened position and the bi-fold floor is positioned to lie in the bottom opening of the multi-sided body upon movement of the body to assume the expanded, opened position. The pivotable tabs are arranged to lie under the bi-fold floor and cooperate with the bi-fold floor to define a bottom structure closing the bottom opening of the body and having a relatively flat interior wall free of any tab portions lying atop of the bi-fold floor in the midsections thereof and facing into the interior region of the body upon movement of the multi-sided body to assume its expanded, opened position.

In preferred embodiments, the collapsible container is a somewhat octagon-shaped bulk box and the body is eight-sided and includes a set of eight walls arranged consecutively in series to provide the eight-sided body with an "octagon" shape upon movement of the eight-sided body to assume the expanded, opened position. Although two of the eight walls, which two walls are formed to include hand-grip slots, are folded to give the impression that the bulk box has ten walls, the bulk box really has eight walls, six of which are flat and two of which are folded slightly.

A bottom panel including the bi-fold floor and some of the tabs (e.g., links) is coupled to the eight-sided body and configured to fold during expansion and collapse of the collapsible container. Others of the tabs (e.g., end flaps) are coupled to the eight-sided body and configured to be folded during expansion and collapse of the collapsible container.

When the body is moved to assume its expanded, opened (i.e., erect) position, the bi-fold floor is positioned to close "most" of the bottom opening in the body. The tabs (e.g., links and end flaps) are moved to lie under the floor and close any openings formed between the body and the bi-fold floor so as to close the "rest" of the bottom opening in the body. None of the tabs extend into the interior region of the erect container. As a result, the bottom structure of the collapsible container defined by the bottom panel and the end flaps provides a relatively flat interior bottom wall in the erect container.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the following figures in which:

FIG. 16 is a perspective view showing application of a force to one end of the container while another end of the container contacts a flat surface during a first stage of container expansion;

FIG. 17 is a perspective view showing application of another force to an exterior surface of the bottom panel during a second stage of container expansion; and FIG. 18 is a perspective view showing turning of the container from the position shown in FIG. 17 toward the position shown in FIG. 1 to fold various bottom flaps appended to the outer panel under the bottom panel during a third stage of container expansion.

DETAILED DESCRIPTION OF THE DRAWINGS

Figure 1:
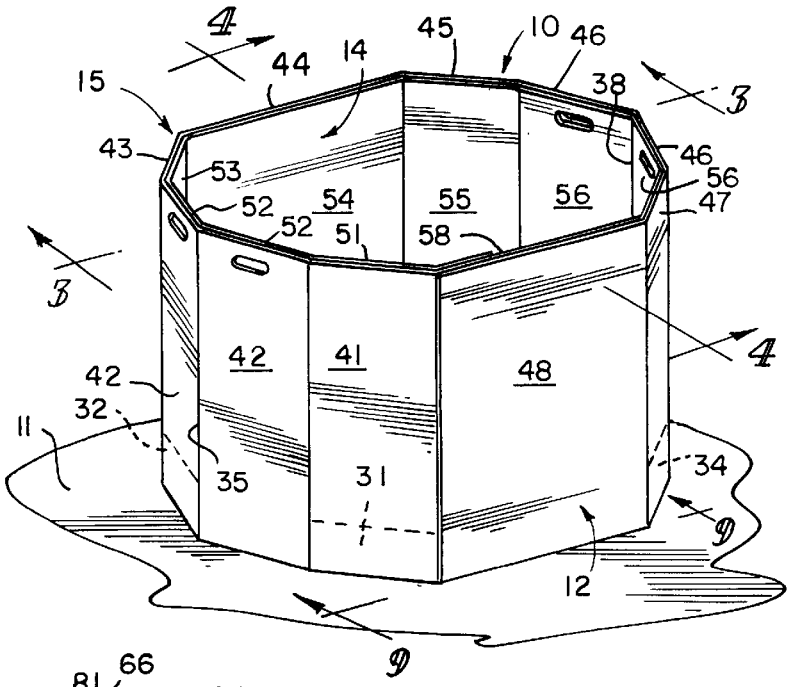
FIG. 1 is a perspective view of an erected container in accordance with the present invention setting on a flat surface and showing vertical side walls included in the container and a somewhat octagon-shaped top opening defined by upper edges of the container side walls.
Figure 2:
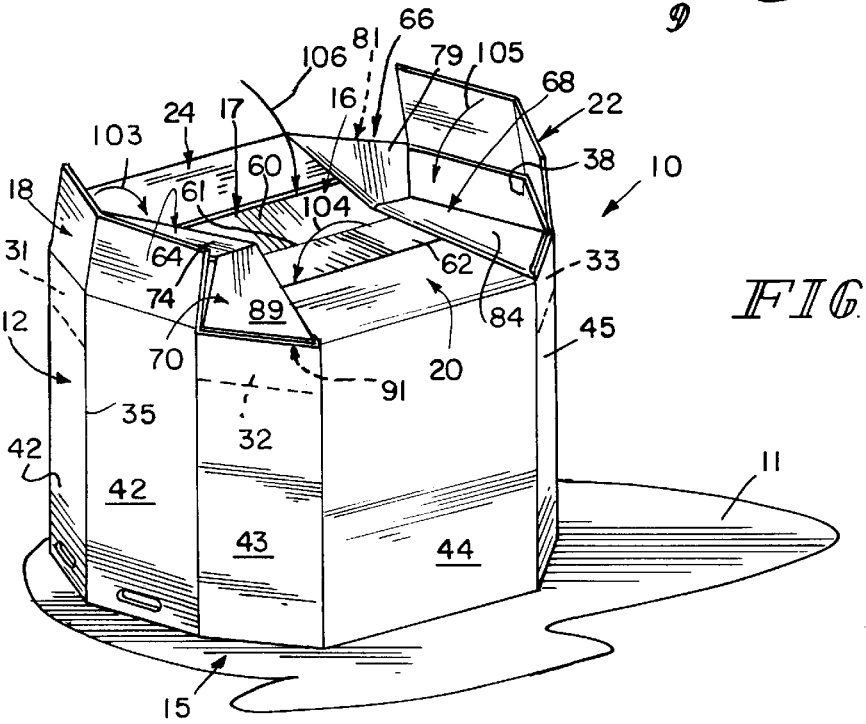
FIG. 2 is a perspective view of the container of FIG. 1 (after the container has been inverted) showing exterior portions of the bottom structure of the container and four bottom flaps that are appended to the container side walls and configured to fold inwardly and form additional portions of the bottom structure when the container is returned to the normal upright position shown in FIG. 1.

A collapsible container 10 having effectively eight side walls and a foldable bottom structure is shown setting on a flat surface 11 in FIGS. 1 and 2. Collapsible container 10 is a rapid set-up, multi-sided, bulk box that, once erected, has an open interior region free of any upwardly extending tabs and a relatively flat bottom structure. The foldable bottom structure of container 10 includes a bi-fold floor and a plurality of tabs coupled for pivotable movement to certain side walls of container 10 and arranged to lie outside of the interior region of container 10 and underlie and support exterior surfaces of the bi-fold floor so that container 10, once erected, is provided with a bottom structure having a relatively flat interior wall facing into the interior region of container 10.

Figure 11:
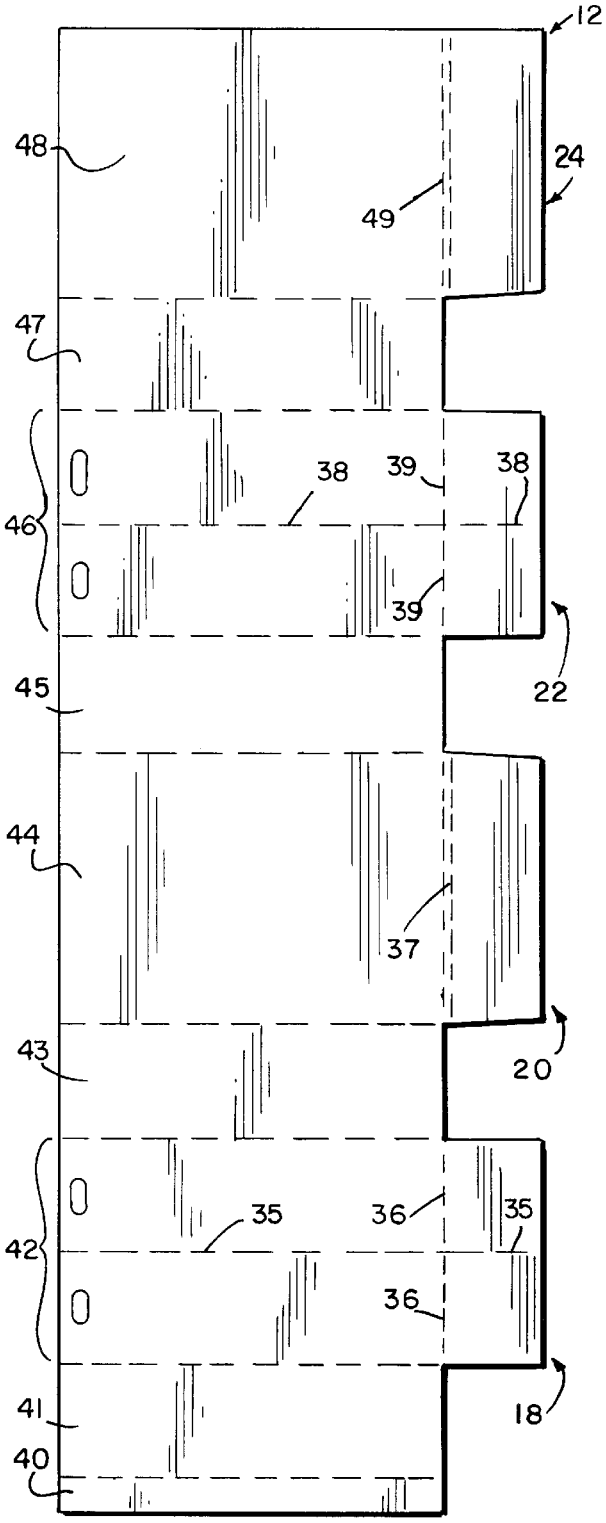
FIG. 11 is a plan view of a blank used to define the outer panel of the container.
Figure 12:
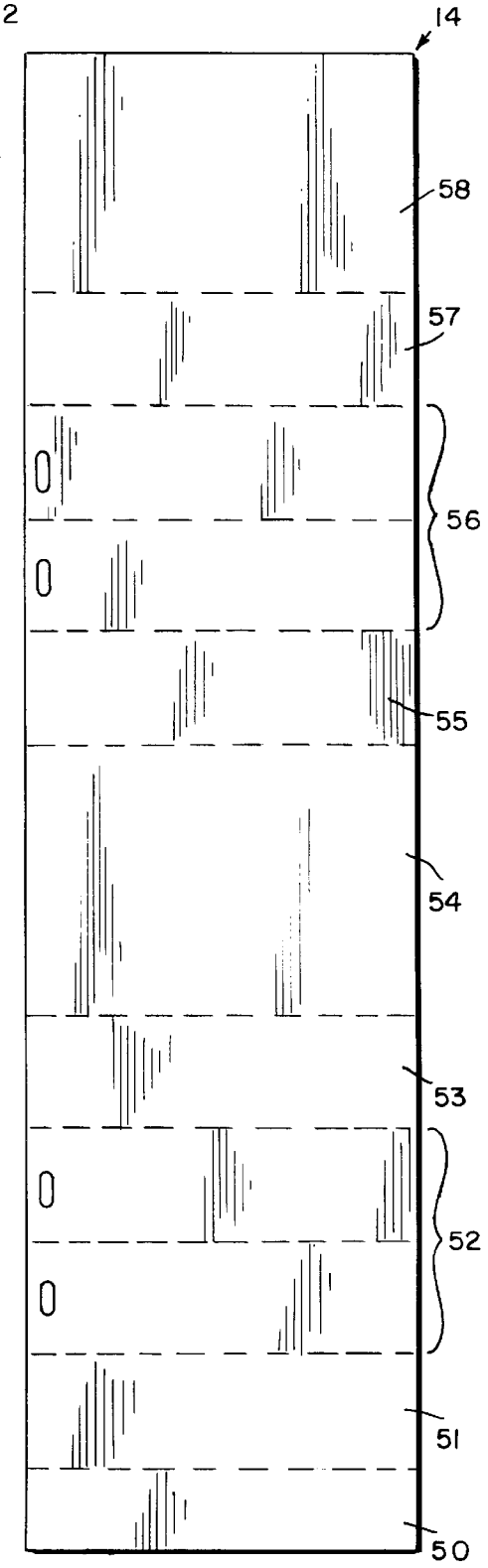
FIG. 12 is a plan view of a blank used to define the inner panel of the container.
Figure 13:
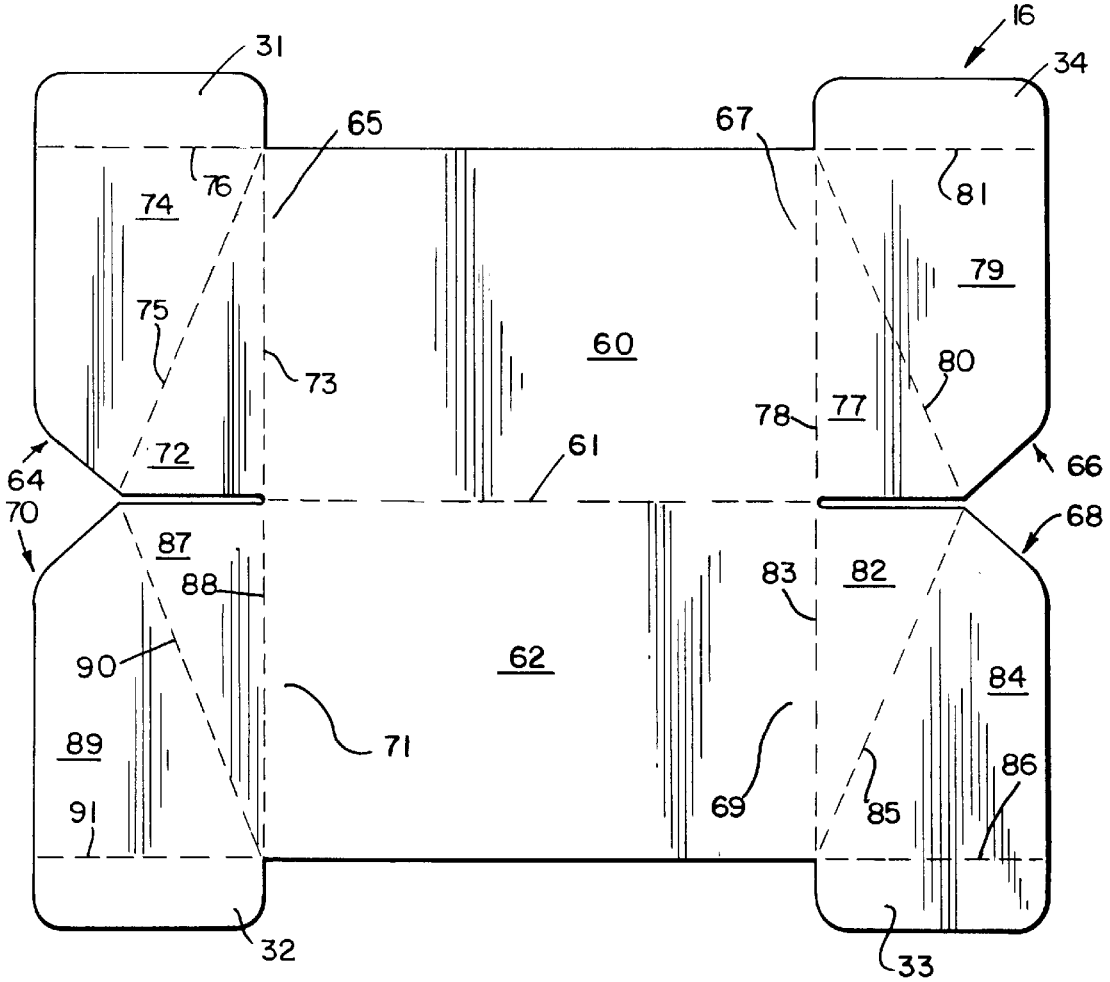
FIG. 13 is a plan view of a blank used to define the bottom panel and coupled to the inner panel to define a portion of the bottom structure of the container.
Figure 14:
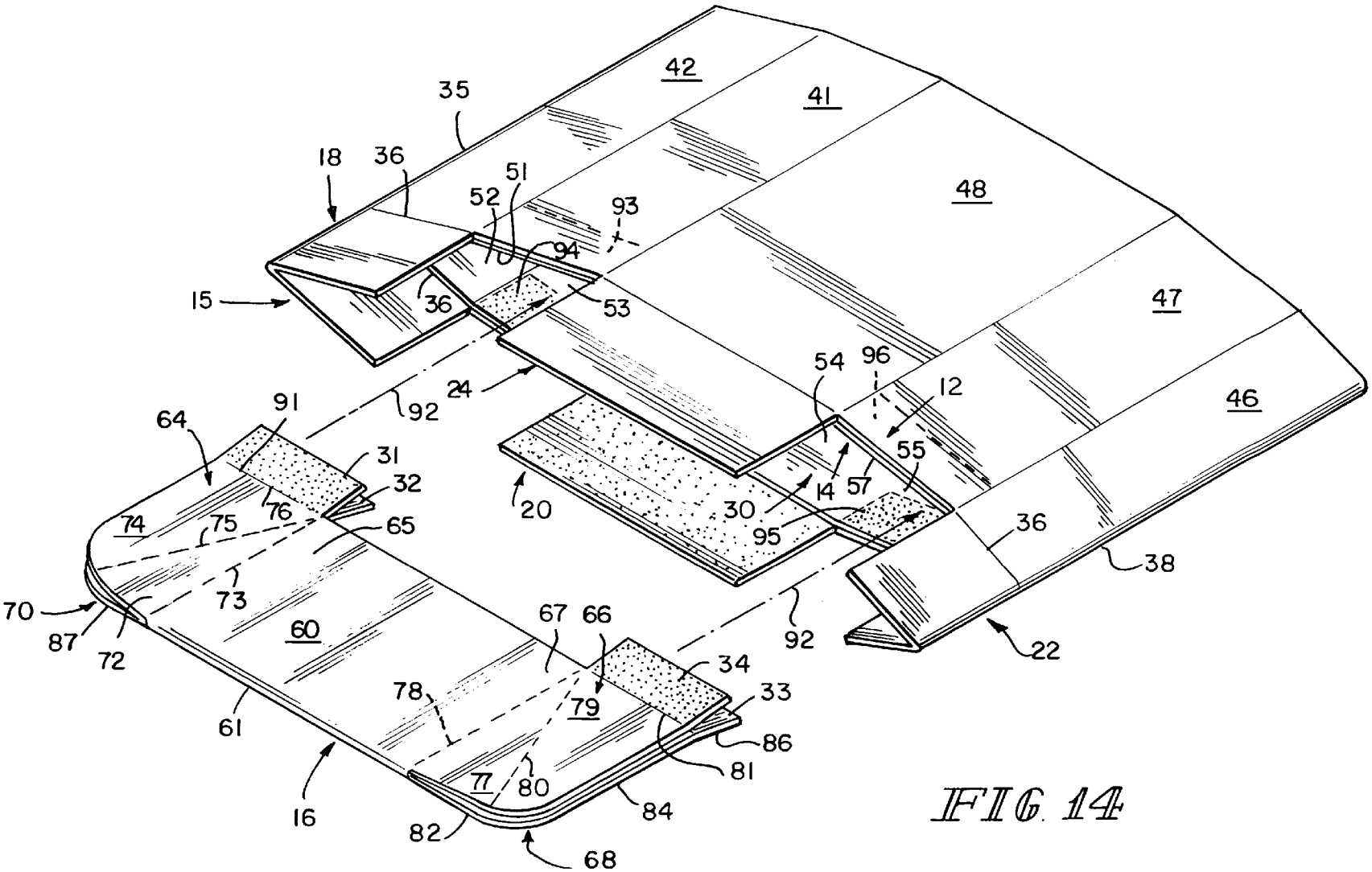
FIG. 14 is a perspective view of the folded bottom panel before it is coupled to a folded body defined by the inner and outer panels at four locations on the inner panel of the folded body.
Figure 15:
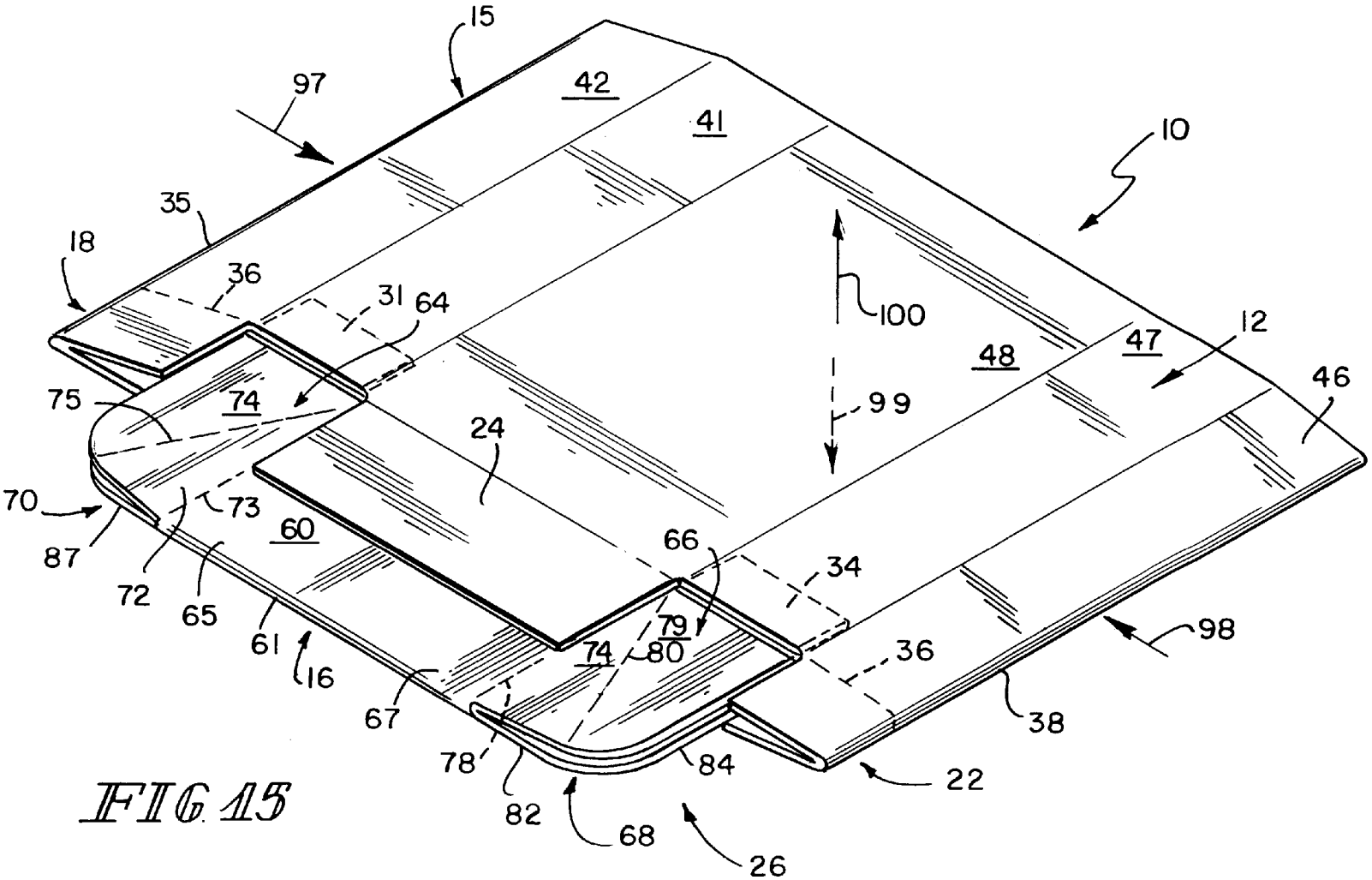
FIG. 15 is a perspective view of the folded bottom panel after it has been coupled to the folded body defined by the inner and outer panels to create an expandable and collapsible container and showing the container in a collapsed, flattened position.
Figure 16:
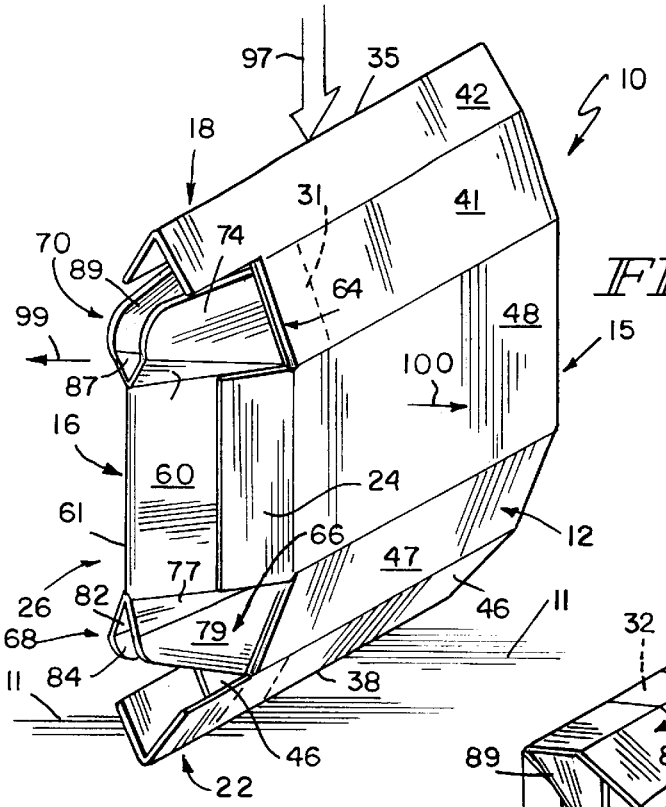
FIGS. 16–18 show a sequence wherein various external forces are applied to the container shown in FIG. 15 to expand the container from a collapsed, flattened position to an upright, opened position.
Figure 17:
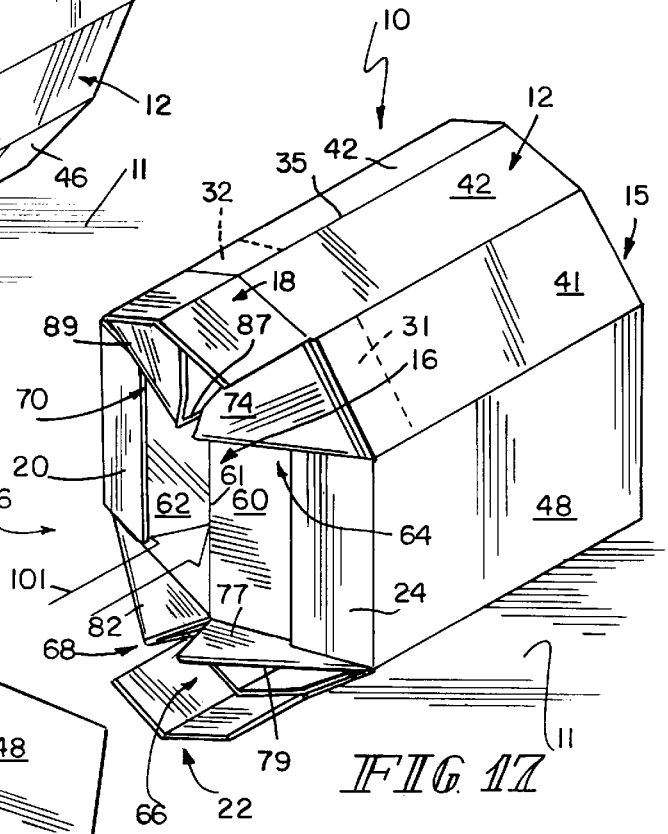
Figure 18:
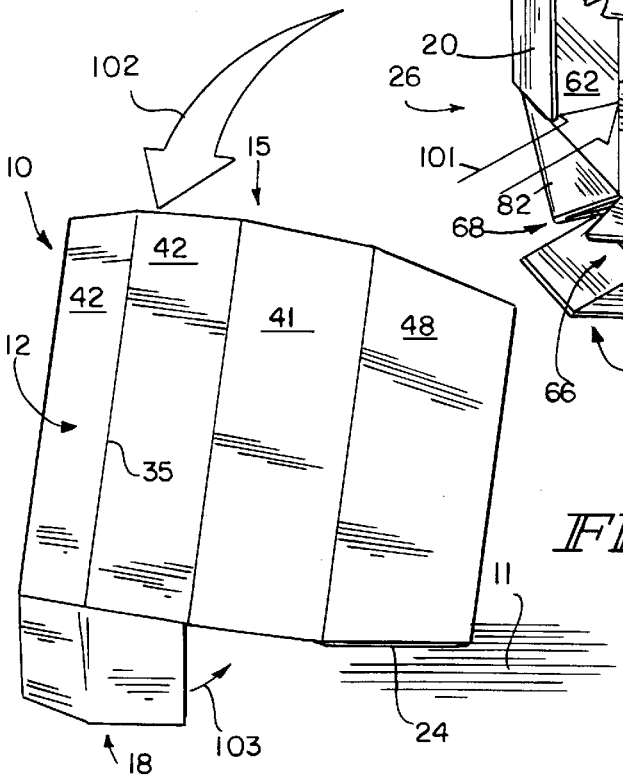

Three separate die-cut blanks used to make a presently preferred embodiment of collapsible container 10 are shown in FIGS. 11–13 and some container assembly steps are shown in FIGS. 14 and 15. A sequence is shown in FIGS. 16–18 wherein various external forces are applied to the container shown in FIG. 15 to expand the container from a collapsed, flattened position to an upright, opened position.

Container 10 comprises an outer panel 12, an inner panel 14, and a bottom panel 16. The outer and inner panels 12, 14 are coupled (e.g., glued) together to form a body 15 and folded to define the side walls. The bottom panel 16 is coupled (e.g., glued) to the body 15 and positioned to cooperate with bottom flaps 18, 20, 22, 24 to form a foldable bottom structure 26 that is coupled to the side walls and collapsible therewith.

It is within the scope of the present invention to construct a container using only outer panel 12 and bottom panel 16.

Figure 3:
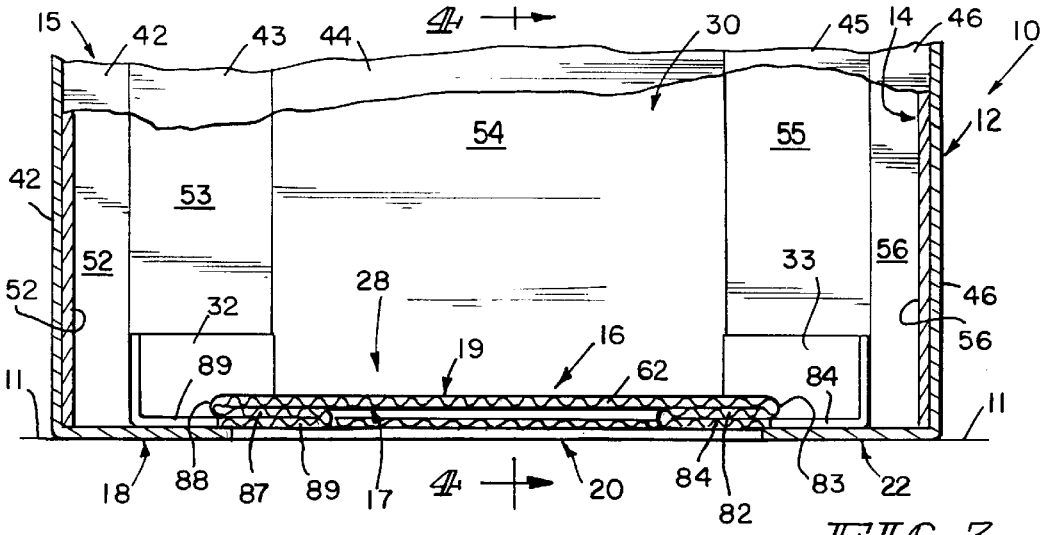
FIG. 3 is a transverse sectional view of the container taken along line 3—3 of FIG. 1 showing a cross section of a relatively flat interior bottom wall defined by the bottom structure along the "length" of the container.
Figure 4:
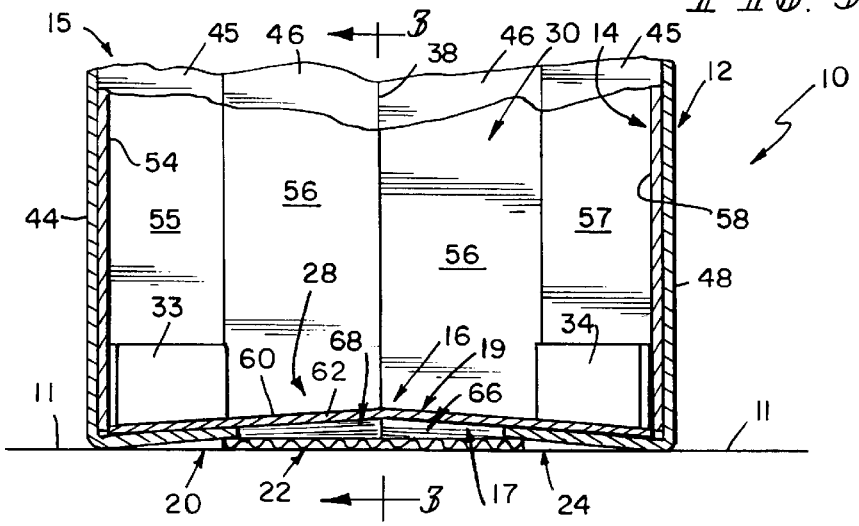
FIG. 4 is a transverse sectional view of the container taken along line 4—4 of FIG. 1 showing a cross section of a relatively flat interior bottom wall defined by the bottom structure along the "width" of the container.
Figure 5:
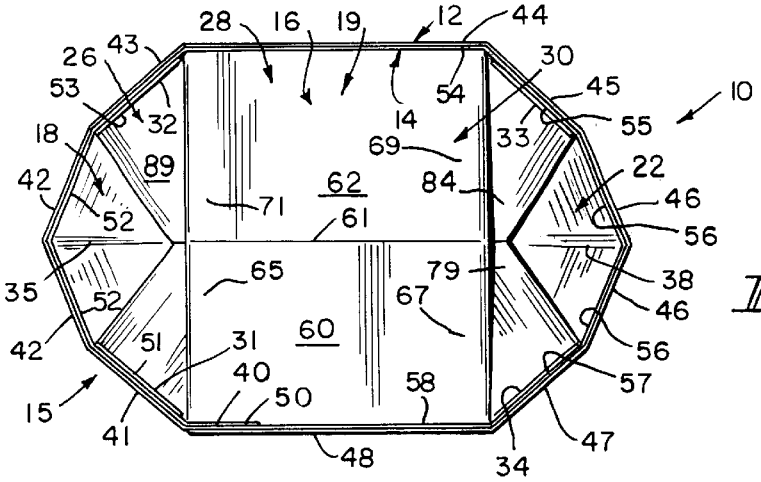
FIG. 5 is a plan view of the container of FIG. 1 showing portions of the bottom flaps and portions of a bottom panel that cooperate to define the bottom structure of the container and provide a relatively flat interior bottom wall inside the container.
Figure 6:
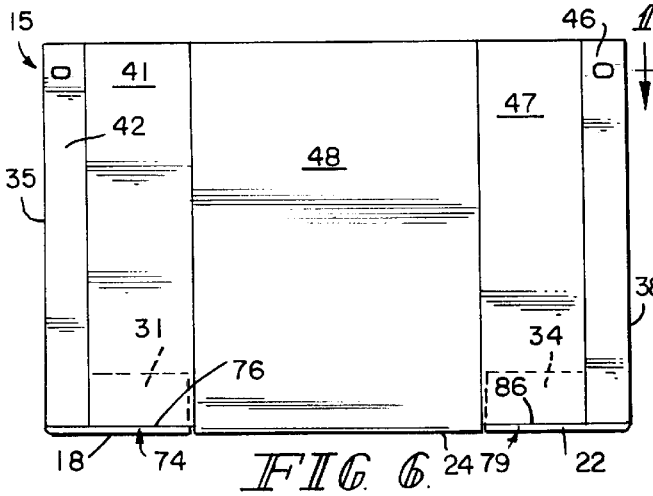
FIG. 6 is a front elevation view of the container of FIGS. 1 and 5.
Figure 7:
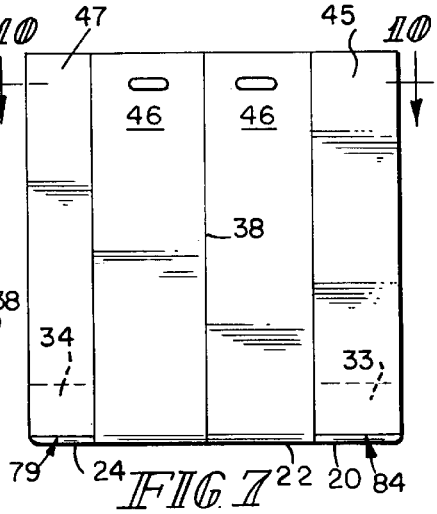
FIG. 7 is a right-side elevation view of the container of FIGS. 1, 5, and 6.

As shown best in FIGS. 3–5, container 10 includes an interior bottom wall or floor 28 that is relatively flat and free of any upwardly extending tabs so as to provide an open interior region 30 within container 10. Foldable bottom structure 26 is configured so that its bottom panel 16 does not include any tabs that extend into interior region 30 of container 10 as seen best in FIGS. 3 and 4 and that the four bottom flaps 18, 20, 22, 24 lie wholly outside interior region 30 of container 10 as seen best in FIGS. 2, 9, 16, and 17. Bottom panel 16 includes four ears 31, 32, 33, 34 that are coupled to body 15 to support bottom panel 16 along a bottom edge of body 15 for movement between a relatively flat configuration when container 10 is in its expanded, upright, use position as shown, for example, in FIGS. 1 and 3–5 and a folded configuration when container 10 is in its collapsed, flattened, storage position as shown, for example, in FIG. 15.

Outer panel 12 is a die-cut blank made of a paperboard such as a corrugated material. As shown in FIG. 11, outer panel 12 includes, in series, a connection flange 40, first wall 41, second wall 42, third wall 43, fourth wall 44, fifth wall 45, sixth wall 46, seventh wall 47, and eighth wall 48. Scored fold lines between adjacent walls are represented by dotted lines. First end bottom flap 18 is appended to one end of second wall 42 and second wall 42 and first end bottom flap 18 are scored along perpendicular folding score lines 35, 36. First side bottom flap 20 is appended to one end of fourth wall 44 along folding score line 37. Second end bottom flap 22 is appended to one end of sixth wall 46 and sixth wall 46 and second end bottom flap 22 are scored along perpendicular folding score lines 38, 39. Second side bottom flap 24 is appended to one end of eighth wall 48 along folding score line 49. Each of bottom flaps 18, 20, 22, 24 is arranged to lie along one perimeter edge of the walls 41–48 as shown in FIG. 11.

Inner panel 14 is made of a paperboard such as a corrugated material. As shown in FIG. 12, inner panel 14 includes, in series, a connection flange 50, first wall 51, second wall 52, third wall 53, fourth wall 54, fifth wall 55, sixth wall 56, seventh wall 57, and eighth wall 58. Scored fold lines between adjacent walls are represented by dotted lines. The walls in each pair of adjacent walls in the set of eight walls 51 to 58 are articulated to one another to define a fold line therebetween. Once assembled, there will be a fold line between first wall 51 and eighth wall 58 as shown, for example, in FIG. 10.

Figure 10:
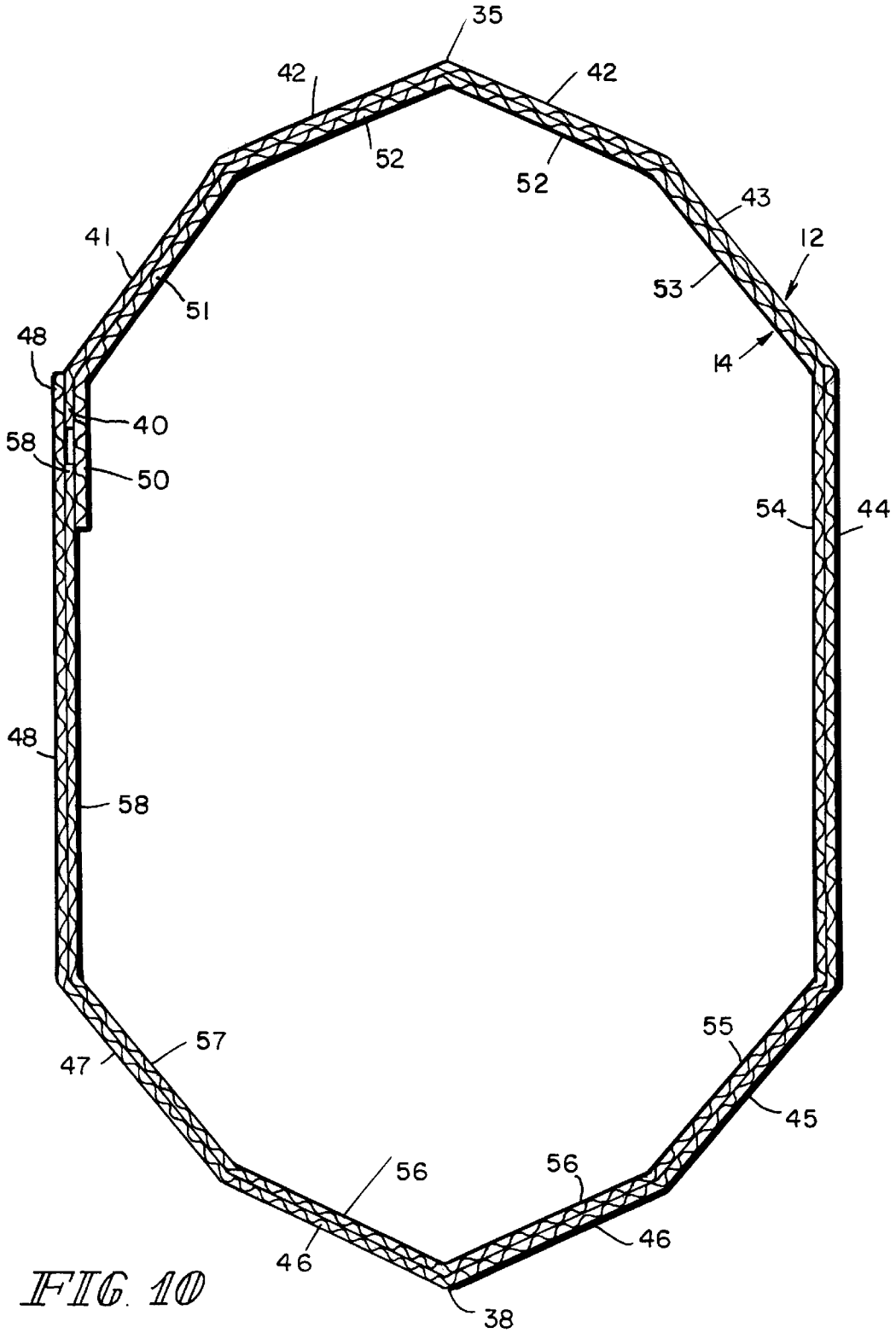
FIG. 10 is a longitudinal section taken along line 10—10 of FIG. 7 showing only the side walls of the container and showing the use of an outer panel and an inner panel to cause each side wall to have a double-walled construction.

During a first stage of container construction, inner panel 14 is coupled (e.g., glued) to outer panel 12 so that the following pairs of flanges and walls are aligned and coupled as shown, for example, in FIG. 10: (40, 50), (41, 51), (42, 52), (43, 53), (44, 54), (45, 55), (46, 56), (47, 57), and (48, 58). The flanges and walls are aligned so that the folding score lines (represented by dotted lines in FIG. 12) in inner panel 14 align with the folding score lines (represented by dotted lines in FIG. 11) in outer panel 12. In a next stage, body 15 is formed by coupling (e.g., gluing) connection flange 40 to eighth wall 48 in outer panel 12 at a location adjacent to eighth wall 58 in inner panel 14 and coupling (e.g., gluing) connection flange 50 in inner panel 14 to connection flange 40 in outer panel 12 and to eighth wall 58 in inner panel 14 as shown, for example, in FIG. 10 so that connection flange 40 is trapped between eighth wall 48 in outer panel 12 and connection flange 50 in inner panel 14. Body 15 can now be collapsed and expanded along its folding score lines to move between a somewhat octagon-shaped expanded position shown in FIG. 10 and a flattened collapsed position shown in FIG. 15.

Construction of container 10 is continued by coupling (e.g., gluing) bottom panel 16 to body 15 as shown, for example, in FIGS. 14 and 15. Folded bottom panel 16 is moved in direction 92 as shown in FIG. 14 to cause ears 31, 32, 33, 34 to move into interior region 30 of body 15. Using glue or some suitable connector, ear 31 is coupled to region 93 on wall 51 of inner panel 14, ear 32 is coupled to region 94 on wall 53 of inner panel 14, ear 33 is coupled to region 95 on wall 54 of inner panel 14, and ear 34 is coupled to region 96 on wall 57 of inner panel 14. In an alternative embodiment (not shown), one or more of ears 31, 32, 33, 34 could be coupled to outer panel 12 instead of inner panel 14. As noted previously, a container within the scope of the present invention could be formed by coupling bottom panel 16 directly to outer panel 12. Ears 31, 32, 33, 34 could be coupled to either an interior surface or an exterior surface of outer panel 12.

Bottom panel 16 is also a die-cut blank made of a paperboard such as corrugated material. As shown in FIG. 13, bottom panel 16 includes a bi-fold floor having a floor section 60 and a floor section 62 appended to floor section 60 along floor fold line 61 to enable pivoting movement of floor section 62 relative to floor section 60 about floor fold line 61 during expansion and collapse of container 10 as shown, for example, in FIGS. 15–17.

Figure 9:
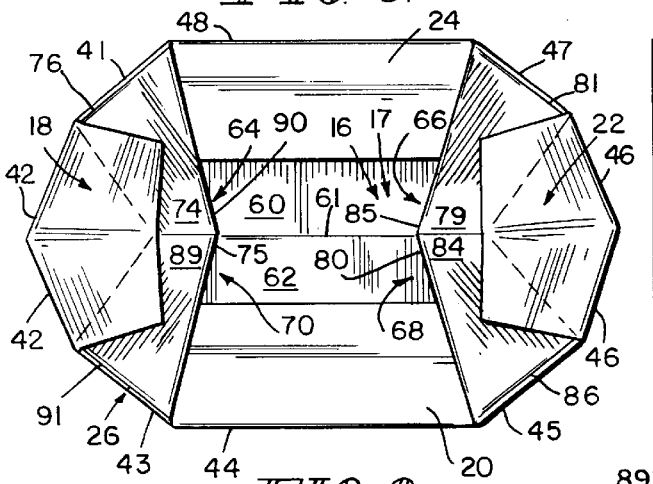
FIG. 9 is a bottom view of the container taken along line 9—9 of FIG. 1 showing the bottom panel in a spread position forming a portion of the bottom structure of the container and showing the four bottom flaps of FIG. 2 in their inwardly folded positions adjacent to the bottom panel to form additional portions of the bottom structure of the container (when the container is setting in an upright position on a flat surface as shown in FIG. 1)
Figure 8:
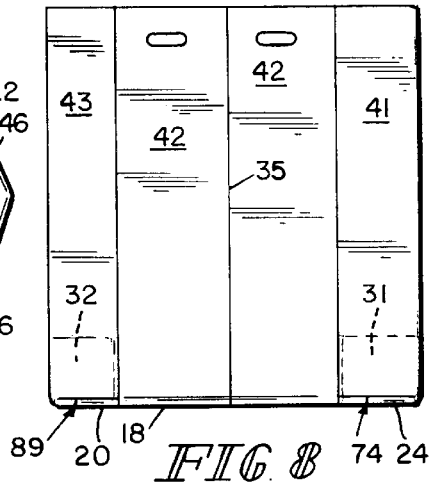
FIG. 8 is a left-side elevation view of the container of FIGS. 1, 5, and 6.

As shown, for example, in FIGS. 2, 5, and 9, a plurality of tabs 74, 79, 84, 89 coupled for pivotable movement to body 15 of container 10 cooperate to underlie and support exterior surfaces of floor sections 60, 62 when container 10 is in an upright position shown, for example, in FIG. 1 without extending upwardly into interior region 30 of container 10 as shown, for example, in FIGS. 3, 4, and 5. These tabs are arranged to pivot relative to the side panel of container 10 during expansion and collapse of container 10 to enable external forces to be applied to container 10 as shown, for example, in FIG. 15 to expand container 10 from a collapsed, flattened position to an upright, opened position. Container 10 is a box that, once erected, has an open interior region free of any upwardly extending tabs that overlie the middle portions of the relatively flat interior bottom wall or floor as shown, for example, in FIGS. 3, 4, and 5.

Two collapsible floor mounts are configured to support floor 60, 62 of bottom panel 16 in a "flattened" position as shown, for example, in FIGS. 3–5 wherein floor sections 60, 62 lie in substantially coplanar relation to one another when container 10 is moved to assume an expanded, opened position. Two collapsible floor mounts are also configured to support floor 60, 62 of bottom panel 16 in a "folded" position as shown, for example, in FIG. 15 wherein floor section 62 is pivoted about floor fold line 61 to lie in close proximity to floor section 60 (i.e., either contacting floor section 60 or defining a small acute dihedral angle between floor sections 60, 62) when container 10 is moved to assume a collapsed, flattened position.

As shown in FIG. 13, bottom panel 16 further includes a first collapsible floor mount coupled for pivotable movement to ends 65, 71 of floor sections 60, 62 and to either inner panel 14 as shown in the drawings or to outer panel 12 and a second collapsible floor mount coupled for pivotable movement to ends 67, 69 of floor sections 60, 62 and to either inner panel 14 as shown in the drawings or to outer panel 12. The first collapsible floor mount includes a foldable first link defined by ear 31 and wing 64 and a foldable second link defined by ear 32 and wing 70 as shown, for example, in FIG. 13. The second collapsible floor mount includes a foldable first link defined by ear 33 and wing 68 and a foldable second link defined by ear 34 and wing 66 as shown, for example, also in FIG. 13. A first wing 64 is appended to ear 31 and to one end 65 of floor section 60, a second wing 66 is appended to ear 34 and another end 67 of floor section 60, a third wing 68 is appended to ear 33 and to one end 69 of floor section 62, and a fourth wing 70 is appended to ear 34 and to another end 71 of floor section 62.

First wing 64 includes a triangle-shaped inner wing section 72 appended to floor section 60 along wing fold line 73 and a quadrilateral-shaped outer wing section 74 appended to first section 72 along diagonal fold line 75 and to ear 31 along ear fold line 76. Second wing 66 includes a triangle-shaped inner wing section 77 appended to floor section 60 along wing fold line 78 and a quadrilateral-shaped outer wing section 79 appended to inner wing section 77 along diagonal fold line 80 and to ear 34 along ear fold line 81. Third wing 68 includes a triangle-shaped inner wing section 82 appended to floor section 62 along wing fold line 83 and a quadrilateral-shaped outer wing section appended to inner wing section 82 along diagonal fold line 84 and to ear 33 along ear fold line 85. Fourth wing 70 includes a triangle-shaped inner wing section 87 appended to floor section 62 along wing fold line 88 and a quadrilateral-shaped outer wing section 89 appended to inner wing section 87 along diagonal fold line 90 and to ear 32 along ear fold line 91.

Container 10 can be moved easily from its collapsed, flattened position to its expanded, opened position in the manner shown in FIGS. 15–18. External forces 97, 98 are applied, for example, to edges 35, 38 of second and sixth walls 42, 46 of outer panel 12 to cause body 15 to expand as fourth wall 44 (along with wall 54) moves in first direction 99 and eighth wall 48 (along with wall 58) moves in an opposite second direction 100 as shown in FIG. 15. External forces 97 and 98 can be applied as shown in FIG. 16 by resting edge 38 of sixth wall 46 on hard surface 11 and applying force 97 to edge 35 of second wall 42. Then, an external force 101 is applied, for example, to edge 61 between floor sections 60, 62 as shown in FIG. 17 to move bottom panel 16 to assume a spread configuration. Finally, container 10 is turned relative to surface 11 in direction 102 to fold bottom flaps 18, 20, 22, 24 in directions 103, 104, 105, 106 as shown, for example, in FIGS. 18 and 2 to place the carton in its upright position shown in FIG. 1.

Although the invention has been described in detail with reference to certain preferred embodiments, variations and modifications exist within the scope and spirit of the invention as described and defined in the following claims.

I claim:

1. A collapsible container having an expanded open position and a collapsed position, comprising a body including a side panel arranged to define an interior region and a bottom panel including a floor having a first floor section and a second floor section coupled to the first floor section at a floor fold line to enable pivoting movement of the second floor section relative to the first floor section about the floor fold line, a first collapsible floor mount coupled to the first and second floor sections and to the side panel, and a second collapsible floor mount coupled to the first and second floor sections and to the side panel, the first and second collapsible floor mounts cooperating to support the floor in one of a flat position wherein the first and second floor sections lie in coplanar relation to one another in the expanded, opened position and a collapsed position wherein the second floor section is pivoted about the floor fold line to lie in close proximity to the first floor section and the floor fold line is positioned to lie outside the interior region defined by the side panel in the collapsed, flattened position.

2. The container of claim 1, wherein the first floor section includes an edge arranged to lie in spaced-apart parallel relation to the floor fold line and the edge of the first floor section is positioned to lie adjacent to the side panel and the edge is arranged to enable relative movement between the first floor section and the side panel during pivoting movement of the second floor section relative to the first floor section.

3. The container of claim 2, wherein the second floor section includes an edge arranged to lie in spaced-apart parallel relation to the floor fold line and the edge of the second floor section is positioned to lie adjacent to the side panel and the edge is arranged to enable relative movement between the second floor section and the side panel during pivoting movement of the second floor section relative to the first floor section.

4. The container of claim 2, wherein the first collapsible floor mount includes one link coupled at one end thereof to one end of the first floor section and at another end thereof to the side panel and the second collapsible floor mount includes another link coupled at one end thereof to an opposite end of the first floor section and at another end thereof to the side panel.

5. The container of claim 4, wherein each link includes an ear coupled to the side panel, an inner wing section coupled to the first floor section at a wing fold line to enable pivoting movement of the inner wing section relative to the first floor section during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

6. The container of claim 4, wherein the first collapsible floor mount further includes one link coupled at one end thereof to one end of the second floor section and at another end thereof to the side panel and the second collapsible floor mount further includes another link coupled at one end thereof to an opposite end of the second floor section and at another end thereof to the side panel.

7. The container of claim 6, wherein each link includes an ear coupled to the side panel, an inner wing section coupled to the floor at a wing fold line to enable pivoting movement of the inner wing section relative to the floor during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

8. The container of claim 1, wherein the first collapsible floor mount includes a first link coupled at one end thereof to the first floor section and at another end thereof to the side panel and a second link coupled at one end thereof to the second floor section and at another end thereof to the side panel.

9. The container of claim 8, wherein the first link includes a first wing coupled to the first floor section and a first ear coupled to the side panel and coupled to the first wing at an ear fold line to enable pivoting movement of the first wing relative to the first ear about the ear fold line during pivoting movement of the second floor section relative to the first floor section.

10. The container of claim 9, wherein the first wing includes an inner wing section coupled to the first floor section at a wing fold line to enable pivoting movement of the inner wing section relative to the first floor section during pivoting movement of the second floor section relative to the first floor section and an outer wing section coupled to the first ear at the ear fold line to enable pivoting movement of the outer wing section relative to the first ear during pivoting movement of the second floor section relative to the first floor section and coupled to the inner wing section at a diagonal fold line to enable pivoting movement of the outer wing section relative to the inner wing section during pivoting movement of the second floor section relative to the first floor section.

11. The container of claim 10, wherein the inner wing section is triangle-shaped and the outer wing section is quadrilateral-shaped.

12. The container of claim 9, wherein the second link includes a second wing coupled to the second floor section and a second ear coupled to the side panel and coupled to the second wing at a second ear fold line to enable pivoting movement of the second ear about the second ear fold line during pivoting movement of the second floor section relative to the first floor section.

13. The container of claim 12, wherein the second wing includes an inner wing section coupled to the second floor section at a wing fold line to enable pivoting movement of the inner wing section relative to the second floor section during pivoting movement of the second floor section relative to the first floor section and an outer wing section coupled to the second ear at the ear fold line to enable pivoting movement of the outer wing section relative to the second ear during pivoting movement of the second floor section relative to the first floor section and coupled to the inner wing section at a diagonal fold line to enable pivoting movement of the outer wing section relative to the inner wing section during pivoting movement of the second floor section relative to the first floor section.

14. The container of claim 13, wherein the inner wing section is triangle-shaped and the outer wing section is quadrilateral-shaped.

15. A collapsible container comprising a body including a side panel arranged to define an interior region and a bottom panel including a floor having a first floor section and a second floor section coupled to the first floor section at a floor fold line to enable pivoting movement of the second floor section relative to the first floor section about the floor fold line, a first collapsible floor mount coupled to the first and second floor sections and to the side panel, and a second collapsible floor mount coupled to the first and second floor sections and to the side panel, the first and second collapsible floor mounts cooperating to support the floor in one of a flat position wherein the first and second floor sections lie in coplanar relation to one another when the collapsible container is arranged in an expanded, opened position and a collapsed position wherein the second floor section is pivoted about the floor fold line to lie in close proximity to the first floor section when the collapsible container is arranged in a collapsed, flattened position, wherein the first floor section includes an edge arranged to lie in spaced-apart parallel relation to the floor fold line and the edge of the first floor section is positioned to lie adjacent to the side panel without being coupled to the side panel to enable relative movement between the first floor section and the side panel during pivoting movement of the second floor section relative to the first floor section.

16. The container of claim 15, wherein the second floor section includes an edge arranged to lie in spaced-apart parallel relation to the floor fold line and the edge of the second floor section is positioned to lie adjacent to the side panel without being coupled to the side panel to enable relative movement between the second floor section and the side panel during pivoting movement of the second floor section relative to the first floor section.

17. The container of claim 15, wherein the first collapsible floor mount includes one link coupled at one end thereof to one end of the first floor section and at another end thereof to the side panel and the second collapsible floor mount includes another link coupled at one end thereof to an opposite end of the first floor section and at another end thereof to the side panel.

18. The container of claim 17, wherein each link includes an ear coupled to the side panel, an inner wing section coupled to the first floor section at a wing fold line to enable pivoting movement of the inner wing section relative to the first floor section during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

19. The container of claim 17, wherein the first collapsible floor mount further includes one link coupled at one end thereof to one end of the second floor section and at another end thereof to the side panel and the second collapsible floor mount further includes another link coupled at one end thereof to an opposite end of the second floor section and at another end thereof to the side panel.

20. The container of claim 19, wherein each link includes an ear coupled to the side panel, an inner wing section coupled to the floor at a wing fold line to enable pivoting movement of the inner wing section relative to the floor during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

21. A collapsible container comprising a body including a side panel arranged to define an interior region and a bottom panel including a floor having a first floor section and a second floor section coupled to the first floor section at a floor fold line to enable pivoting movement of the second floor section relative to the first floor section about the floor fold line, a first collapsible floor mount coupled to the first and second floor sections and to the side panel, and a second collapsible floor mount coupled to the first and second floor sections and to the side panel, the first and second collapsible floor mounts cooperating to support the floor in one of a flat position wherein the first and second floor sections lie in coplanar relation to one another when the collapsible container is arranged in an expanded, opened position and a collapsed position wherein the second floor section is pivoted about the floor fold line to lie in close proximity to the first floor section when the collapsible container is arranged in a collapsed, flattened position, wherein the side panel includes a set of eight walls arranged consecutively in a series to provide the body with an octagon shape upon movement of the container to assume the expanded, opened position, the first collapsible floor mount is coupled to a first wall and a third wall in the series of eight walls, and the second collapsible floor mount is coupled to a fifth wall and a seventh wall in the series of eight walls.

22. The container of claim 21, wherein the body further includes a first end flap coupled for pivotable movement to a second wall in the series of eight walls and a second end flap coupled for pivotable movement to a sixth wall in the series of eight walls and each of the first and second end flaps are positioned to lie against the first and second collapsible floor mounts and under the floor of the bottom panel without extending into the interior region when the container is arranged in an expanded, opened position.

23. The container of claim 22, wherein the body further includes a first side flap coupled for pivotable movement to a fourth wall in the series of eight walls and a second side flap coupled for pivotable movement to an eighth wall in the series of eight walls and each of the first and second side flaps are positioned to lie under the floor of the bottom panel and away from the interior region when the container is arranged in an expanded, opened position.

24. A collapsible container having an expanded position and a collapsed position, comprising a body including a side panel arranged to define an interior region and a bottom panel including a floor having a first floor section and second floor section coupled to the first floor section at a floor fold line to enable pivoting movement of the second floor section relative to the first floor section about the floor fold line to position the floor fold line outside of the interior region defined by the side panel in the collapsed position and in a flat position with the first and second floor sections generally coplanar in the expanded open position, a first link coupled for pivotable movement to the first floor section and to the side panel, a second link coupled for pivotable movement to the first floor section and to the side panel and positioned to lie in spaced-apart relation to the first link, a third link coupled for pivotable movement to the second floor section and to the side panel, and a fourth link coupled for pivotable movement to the second floor section and to the side panel and positioned to lie in spaced-apart relation to the third link.

25. The container of claim 24, wherein each of the first, second, third, and fourth links includes a wing coupled to one of the first and second floor sections at a wing fold line and an ear coupled to the side panel and to the wing at an ear fold line to enable pivoting movement of the wing relative to the ear about the ear fold line and to said one of the first and second floor sections during pivoting movement of the second floor section relative to the first floor section.

26. The container of claim 24, wherein each of the first and second links includes an ear coupled to the side panel, an inner wing section coupled to the first floor section at a wing fold line to enable pivoting movement of the inner wing section relative to the first floor section during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

27. The container of claim 26, wherein each inner wing section is triangle-shaped and each outer wing section is quadrilateral-shaped.

28. The container of claim 26, wherein each of the third and fourth links includes an ear coupled to the side panel, an inner wing section coupled to the second floor section at a wing fold line to enable pivoting movement of the inner wing section relative to the second floor section during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section.

29. The container of claim 28, wherein each inner wing section is triangle-shaped and each outer wing section is quadrilateral-shaped.

30. A collapsible container comprising a body including a side panel arranged to define an interior region and a bottom panel including a floor having a first floor section and second floor section coupled to the first floor section at a floor fold line to enable pivoting movement of the second floor section relative to the first floor section about the floor fold line, a first link coupled for pivotable movement to the first floor section and to the side panel, a second link coupled for pivotable movement to the first floor section and to the side panel and positioned to lie in spaced-apart relation to the first link, a third link coupled for pivotable movement to the second floor section and to the side panel, and a fourth link coupled for pivotable movement to the second floor section and to the side panel and positioned to lie in spaced-apart relation to the third link, wherein the side panel includes a set of eight walls arranged consecutively in series to provide the body with an octagon shape upon movement of the container to assume the expanded, opened position, the first link is coupled at one end thereof to a first wall in the series of eight walls and at another end thereof to one end of the first floor section, the second link is coupled at one end thereof to a seventh wall in the series of eight walls and at another end thereof to an opposite end of the first floor section, the third link is coupled at one end thereof to a fifth wall in the series of eight walls and at another end thereof to one end of the second floor section, and the fourth link is coupled at one end thereof to a third wall in the series of eight walls and at another end thereof to an opposite end of the second floor section.

31. The container of claim 30, wherein each of the first and second links includes an ear coupled to the side panel, an inner wing section coupled to the first floor section at a wing fold line to enable pivoting movement of the inner wing section relative to the first floor section during pivoting movement of the second floor section relative to the first floor section, and an outer wing section coupled to the ear at an ear fold line and to the inner wing section at a diagonal fold line to enable pivoting movement of the outer wing section relative to the ear and to the inner wing section during pivoting movement of the second floor section relative to the first floor section, and each inner wing section is triangle-shaped and each outer wing section is quadrilateral-shaped.

32. The container of claim 30, wherein the body further includes a first end flap coupled for pivotable movement to a second wall in the series of eight walls and a second end flap coupled for pivotable movement to a sixth wall in the series of eight walls and each of the first and second end flaps are positioned to lie against two of the first, second, third, and fourth links and under the floor of the bottom panel without extending into the interior region when the container is arranged in an expanded, opened position.

33. The container of claim 32, wherein the body further includes a first side flap coupled for pivotable movement to a fourth wall in the series of eight walls and a second side flap coupled for pivotable movement to an eighth wall in the series of eight walls and each of the first and second side flaps are positioned to lie under the floor of the bottom panel and away from the interior region when the container is arranged in an expanded, opened position.

34. A collapsible container comprising an eight-sided body formed to include a top opening and a bottom opening and configured to be folded from an expanded, opened position to a collapsed, flattened position, the eight-sided body including a set of eight walls arranged consecutively in a series to provide the eight-sided body with an octagon shape upon movement of the eight-sided body to assume the expanded, opened position, the walls in each pair of adjacent walls in the set of eight walls being articulated to one another to define a fold line therebetween to facilitate folding movement of the eight-sided body between the expanded, opened position and the collapsed, flattened position, bi-fold floor positioned to lie in the bottom opening of the eight-sided body upon movement of the eight-sided body to assume the expanded, opened position, a plurality of tabs coupled for pivotable movement to certain of the walls in the set of eight walls, each tab being arranged to lie under the bi-fold floor and cooperate with the bi-fold floor to define a bottom structure of the container closing the bottom opening of the eight-sided body, and said bi-fold floor facing into an interior region of the body upon movement of the eight-sided body to assume its expanded, opened position without any tabs extending over the bi-fold floor.

35. The container of claim 34, wherein the tabs are quadrilateral-shaped.

36. The container of claim 34, wherein the eight-sided body further includes first and second side flaps, the first side flap is coupled for pivotable movement to a fourth wall in the set of eight walls, the second side flap is coupled for pivotable movement to an eighth wall in the set of eight walls, and each of the first and second side flaps is positioned to lie under the floor of the bottom panel and away from the interior region when the container is arranged in an expanded, opened position.

37. A collapsible container comprising an eight-sided body formed to include a top opening and a bottom opening and configured to be folded from an expanded, opened position to a collapsed, flattened position, the eight-sided body including a set of eight walls arranged consecutively in a series to provide the eight-sided body with an octagon shape upon movement of the eight-sided body to assume the expanded, opened position, the walls in each pair of adjacent walls in the set of eight walls being articulated to one another to define a fold line therebetween to facilitate folding movement of the eight-sided body between the expanded, opened position and the collapsed, flattened position, a bi-fold floor positioned to lie in the bottom opening of the eight-sided body upon movement of the eight-sided body to assume the expanded, opened position, and a plurality of tabs coupled for pivotable movement to certain of the walls in the set of eight walls and arranged to lie under the bi-fold floor and cooperate with the bi-fold floor to define a bottom structure of the container closing the bottom opening of the eight-sided body and having a relatively flat interior wall free of any upwardly extending portions lying above the bi-fold floor and facing into an interior region of the body upon movement of the eight-sided body to assume its expanded, opened position, wherein the eight-sided body further includes first and second end flaps, a first of the tabs is coupled for pivotable movement to a first wall in the set of eight walls, the first end flap is coupled for pivotable movement to a second wall in the set of eight walls, a second of the tabs is coupled for pivotable movement to a third wall in the set of eight walls, a third of the tabs is coupled for pivotable movement to a fifth wall in the set of eight walls, the second end flap is coupled for pivotable movement to a sixth wall in the set of eight walls, a fourth of the tabs is coupled for pivotable movement to a seventh wall in the set of eight walls, and each of the first, second, third, and fourth tabs and each of the first and second end flaps is positioned to lie under the floor and away from the interior region when the container is arranged in an expanded, opened position.

38. A collapsible container comprising a body including an endless side panel formed to include a top opening, a bottom opening, and an interior region accessible through the top and bottom openings, the endless side panel including pairs of articulated walls to enable the body to be folded from an expanded, opened position to a collapsed, flattened position, the body further including first and second end flaps coupled to the endless side panel to lie adjacent to the bottom opening of the body, a bi-fold floor positioned to lie in the bottom opening of the body upon movement of the body to assume the expanded, opened position, the bi-fold floor cooperating with the endless side panel to define spaced-apart first and second openings accessible to the interior region therebetween, a first pair of tabs coupled to the endless side panel and arranged to lie in spaced-apart relation to one another to position the first end flap therebetween, and a second pair of tabs coupled to the endless side panel and arranged to lie in spaced-apart relation to one another to position the second end flap therebetween, and wherein the first end flap and first pair of tabs are positioned to lie under the bi-fold floor and away from the interior region of the body to close the first opening defined by the bi-fold floor and the endless side panel and the second end flap and second pair of tabs are positioned to lie under the bi-fold floor and away from the interior region of the body to close the second opening defined by the bi-fold floor and the endless side panel to cause the bi-fold floor, first and second end flaps, and first and second pairs of tabs to cooperate to close the bottom opening of the body when the container is arranged in the expanded, opened position.

* * * * *